US005560302A

United States Patent [19]

Diffrient et al.

[11] Patent Number: 5,560,302

[45] Date of Patent: Oct. 1, 1996

[54] TABLE BRIDGING APPARATUS

[75] Inventors: Niels Diffrient, Ridgefield; Julia Wilkins, Norwalk, both of Conn.

[73] Assignee: Howe Furniture Corporation, Trumbull, Conn.

[21] Appl. No.: 405,358

[22] Filed: Mar. 16, 1995

[51] Int. Cl.[6] ..... A47B 57/00

[52] U.S. Cl. ..... 108/64; 52/582.2

[58] Field of Search ..... 108/64, 69, 89, 108/90; 52/582.2

[56] References Cited

U.S. PATENT DOCUMENTS

| | | | |
|---|---|---|---|
| 2,836,475 | 5/1958 | Sapp | 108/64 |
| 2,840,431 | 6/1958 | Budai | 108/64 |
| 3,915,100 | 10/1975 | Sullivan | 108/89 |
| 4,665,836 | 5/1987 | Burr | 108/64 |

FOREIGN PATENT DOCUMENTS

| | | | |
|---|---|---|---|
| 0096961 | 8/1960 | Norway | 108/90 |
| 0180923 | 11/1934 | Switzerland | 108/69 |

*Primary Examiner*—Peter M. Cuomo
*Assistant Examiner*—Gerald A. Anderson
*Attorney, Agent, or Firm*—Parmelee, Bollinger & Bramblett

[57] ABSTRACT

A bridge interconnects two table tops and is supported solely by the table tops themselves, employing connector bars which normally serve to gang tables together. Alignment pins on the bottom surface of the bridge engage openings in the connector bars. A separate slidable locking bar on the bridge engages each pair of connector bars to attach the bridge to the two table tops.

12 Claims, 2 Drawing Sheets

TABLE BRIDGING APPARATUS

TECHNICAL FIELD

This invention relates to the field of table construction. More specifically, it relates to the interconnection of table tops by means of a bridge.

BACKGROUND ART

It is a common practice to manufacture tables for institutional use which may be ganged together. It is also common to provide bridge elements for spanning the space between adjacent table tops, the bridge elements being supported solely by the table tops. Such bridging elements, however, normally require the installation of hardware specific to the bridging use.

It would be desirable to provide bridges which would employ the table ganging hardware already installed on the tables. Accordingly, it is a primary object of the present invention to provide such bridging apparatus. Other objects, features and advantages will become apparent from the following description and appended claims.

DISCLOSURE OF INVENTION

The invention comprises bridging apparatus which employs connector bars which are already installed on the underside of the table top. The substantially planar bridge carries alignment pins on its underneath side. The alignment pins are positioned to be received in the alignment openings of the connector bars. A slidable locking bar is mounted on the underneath surface of the bridge and is movable between an unlocked position and a locking position wherein it securely engages the connector bars, thereby locking the bridge in place.

BEST MODE FOR CARRYING OUT THE INVENTION

Figure 1:
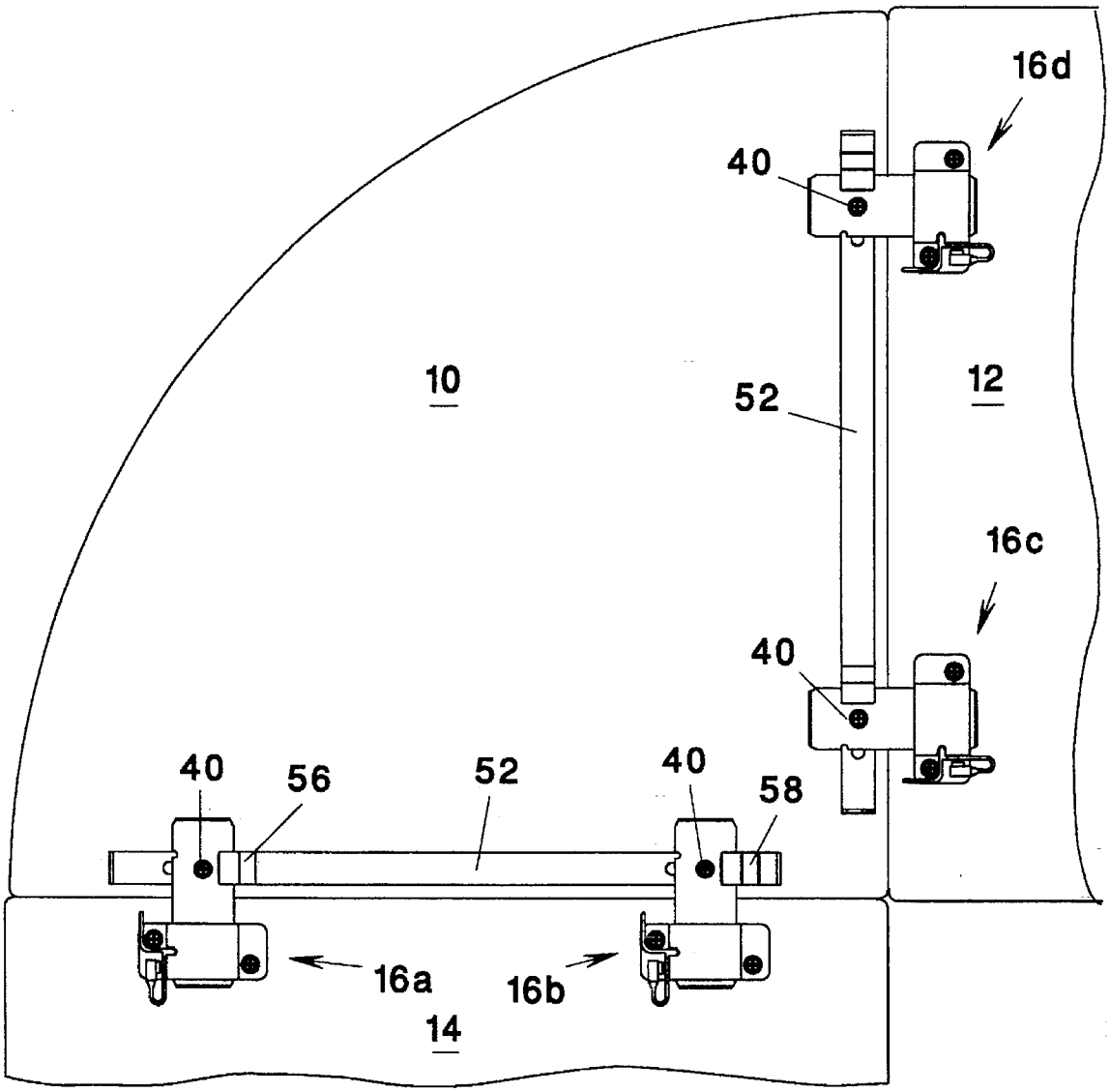
FIG. 1 is a bottom view of a bridge in accordance with the invention connected between two table tops.

FIG. 1 illustrates a bridge member 10 for bridging the space between a pair of table tops 12, 14. The illustrated bridge is in the form of a quarter circle so as to bridge between table tops oriented at 90° with one another. However, a bridge may be of any shape and the only requirement is that it have two edges conforming with the edges of table tops to be interconnected.

The illustration in FIG. 1 is a bottom view. It will be understood that the table tops 12, 14 are supported by suitable leg members. The bridge member 10 is supported solely by the table tops. Each of the table tops 12, 14 carries a pair of identical ganging devices 16*a–d*. These ganging devices are normally employed for interconnecting similarly supplied edges of two table tops. In the present invention, however, they are employed to support the bridge member 10.

Figure 2:
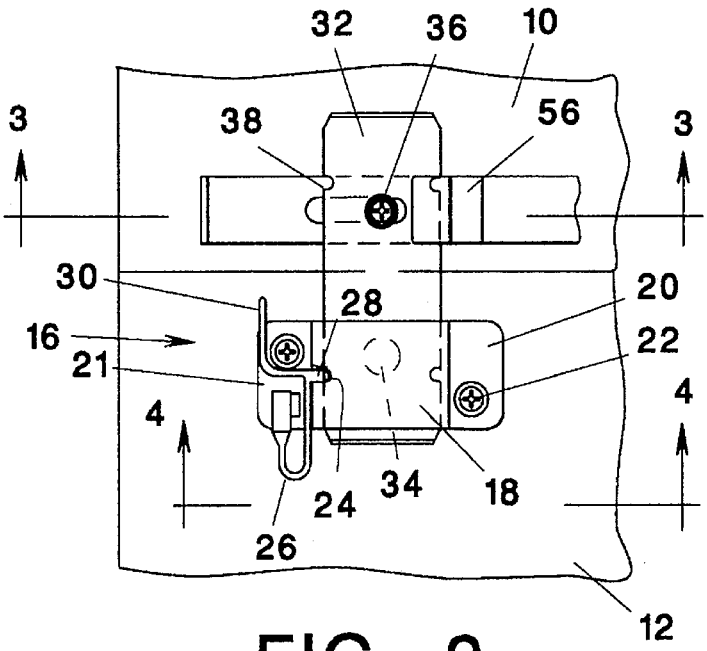
FIG. 2 is an enlarged detail of the locking mechanism of the invention.

FIG. 2 best illustrates the construction of a ganging device 16. It comprises a bracket 18 which is substantially U-shaped and includes a pair of mounting bases 20 as is illustrated most clearly in FIG. 4. The bases 20 are secured to the underneath side of the table top 12 by means of mounting screws 22. One side of the bracket 18 carries a notch 24 (FIG. 2). A tab (hidden) extends upwardly from the mounting base 21 and on this tab is mounted a U-shaped plastic spring 26. The spring 26 includes a projection 28 which extends into the notch 24. A finger operated release lever 30 permits the projection 28 to be manually displaced from the notch. Carried within the bracket 18 is a connector bar 32.

The connector bar 32 is symmetrical and defines along its longitudinal axis a pair of alignment openings 34, 36. In addition, each of the longer edges of the connector bar 32 defines two notches 38. As shown in FIG. 2, the connector bar 32 extends outwardly from the edge of table top 12 and is held in that position by means of the projection 28 engaging the appropriate notch 38 of the connector bar. Alternatively, the connector bar may be stowed beneath the table top by retracting the release lever 30 and pushing the connector bar under the table edge where it is retained by projection 28 engaging the notch 38 in the opposite end of the bar.

Figure 3:
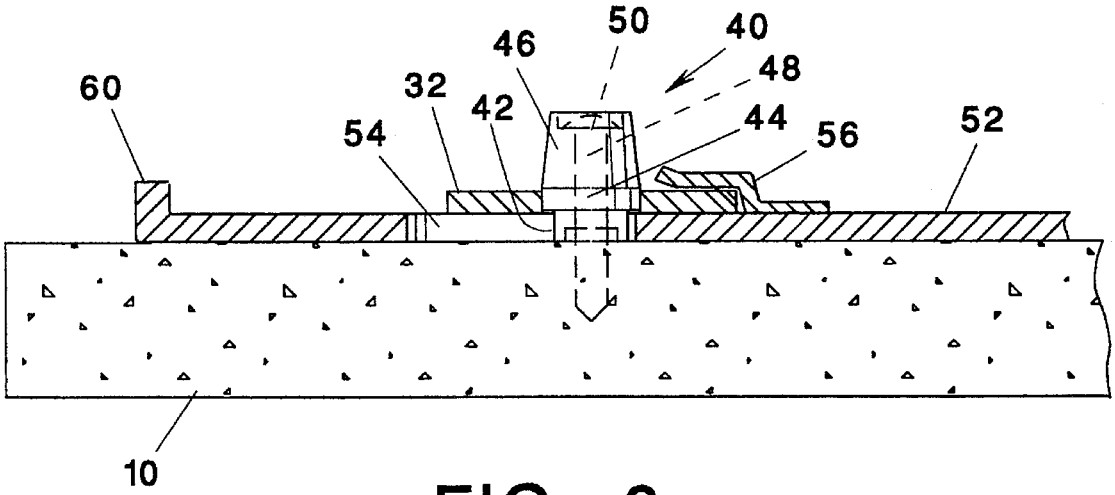
FIG. 3 is an enlarged cross-section taken substantially along the line 3—3 of FIG. 2.

The ganging device 16 is normally employed to gang together table edges. This is achieved by a similar bracket and spring assembly mounted to the other table so that the connector bar 32 is engaged by both. In accordance with the present invention, however, the ganging device is used to support the bridge member. Each edge of the bridge member 10 carries a pair of spaced alignment pins 40 as illustrated in FIG. 3. Each alignment pin 40 has a cylindrical base 42, a cylindrical shoulder 44 of larger diameter, and a tapered body 46. The alignment pin 40 is secured to the bottom surface of the bridge member 10 by means of a screw 48 which extends through an axial opening in the pin. The head of the screw fits within a recess 50 in the top of the alignment pin.

Each pair of alignment pins 40 along an edge of the bridge member carries a locking bar 52. A pair of slots 54 along the longitudinal axis of the locking bar are arranged such that each receives the base 42 of a respective alignment pin therein. The locking bar 52 is thus slidable relative to the alignment pins. The width of each slot 54 is less than the diameter of the shoulder 44 of the pin so that it is retained thereby. Secured to the surface of each locking bar 52, as by welding, is a pair of tabs 56, 58. Each end of the locking bar 52 is bent to provide an actuator 60.

To install the bridge member 10 to one of the table tops 12, 14, the respective locking bar 52 is retracted to the right, as viewed in FIGS. 2 and 3. The bridge member 10 is then lowered onto the protruding connector bars 32 such that the alignment pins 40 extend into the alignment openings 34 in the connector bars. Thereupon locking bar 52 is returned to its leftmost position so that the tabs 56, 58 extend over and engage the respective connector bars 32. This procedure is repeated for each table top to be connected.

Figure 4:
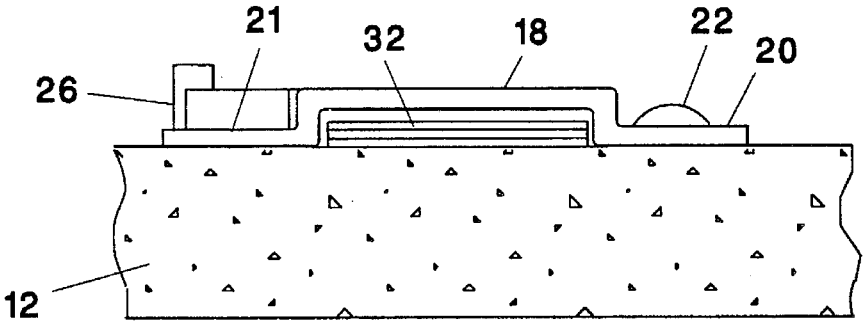
FIG. 4 is an enlarged cross-section taken substantially along the line 4—4 of FIG. 2.

As is illustrated in FIG. 4, the connector bar 32 lies against the underneath surface of the table top 12. However, as shown in FIG. 3, it must extend over the locking bar 52 on the bridge member 10. Accordingly it is most advantageous if the bridge member 10 is thin enough that its width, together with the thickness of the locking bar 52, equals the thickness of the table top 12.

It is believed that the many advantages of this invention will now be apparent to those skilled in the art. It will also be apparent that a number of variations and modifications may be made therein without departing from its spirit and scope. Accordingly, the foregoing description is to be construed as illustrative only, rather than limiting. This invention is limited only by the scope of the following claims.

We claim:

1. Apparatus for bridging a space between two table tops each having an edge to be connected to the other which comprises:

a spaced pair of connector bars extending outwardly from one edge of each of said table tops, each of said connector bars defining an alignment opening therethrough spaced outwardly from its respective table top edge;

a substantially planar bridge member having a top surface and a bottom surface and a first and a second edge:

a first pair of spaced alignment pins carried on the bottom surface of said bridge member adjacent said first edge and positioned to be received in the alignment openings of the connector bar pair extending from the edge of one of said table tops;

a second pair of spaced alignment pins carried on the bottom surface of said bridge member adjacent said second edge and positioned to be received in the alignment openings of the connector bar pair extending from the edge of the other of said table tops;

first locking means on the bottom surface of said bridge member for releasably engaging one of said connector bar pairs; and second locking means on the bottom surface of said bridge member for releasably engaging the other of said connector bar pairs.

2. The apparatus of claim 1 wherein each of said locking means comprises a locking bar having at least one slot therein slidably receiving at least one of said alignment pins.

3. The apparatus of claim 2 wherein a different slot receives each of said alignment pins.

4. The apparatus of claim 3 wherein said locking bar is located between a connecting bar pair and the bottom surface of said bridge member.

5. The apparatus of claim 4 wherein said locking bar carries a tab adapted to receive each of said connecting bars therebetween.

6. For interconnecting (a) a substantially planar bridge member having a top surface, a bottom surface, and first and second edges with (b) a first table top having a top surface, a bottom surface, and an edge and (c) a second table top having a top surface, a bottom surface, and an edge, apparatus which comprises:

a spaced pair of independent first connector bars extending outwardly from one of (a) said bridge member first edge and (b) the edge of said first table top, each of said first connector bars defining an alignment opening therethrough;

a first pair of spaced first alignment pins carried by the bottom surface of the other of said bridge member and first table top, said first pins being positioned to be received in the alignment openings of said first connector bars;

first locking means carried by said first pair of alignmint pins for releasably engaging said first connector bars;

a spaced pair of independent second connector bars extending outwardly from one of (c) said bridge member second edge ans (d) the edge of said decond table top, each of said second connector bars defining an alignment opining therethrough;

a second pair of spaced second alignment pins carried by the bottom surface of the other of saed bridge member and second table top, said second pins being positioned to be received in the alignment opinings of said second commector bars; and second locking means carried by said second pair oa alignment pens for releasably engaging sead second connector bars.

7. The apparatus of claim 6 wherein said locking means comprises:

a locking bar slidably mounted on said alignment pins for travel between a locked position and an unlocked position; and means carried by said locking bar for engaging said connector bars in said locking position and releasing said connector bars in said unlocked position.

8. The apparatus of claim 7 wherein each of said connector bars extends outwardly from its associated table top and said alignment pins are carried by said bridge member.

9. The apparatus of claim 8 wherein said locking bar extends between said connector bars and the bottom surface of said bridge member.

10. The apparatus of claim 9 wherein said locking bar defines a separate slot receiving each of said alignment pins slidably therethrough.

11. The apparatus of claim 10 wherein said engaging means comprises a tab spaced from said locking bar to receive one of said connector bars therebetween.

12. The apparatus of claim 11 wherein each of said connector bars is retractable into a storage position beneath said table top.

* * * * *